US006686701B1

(12) United States Patent
Fullarton

(10) Patent No.: US 6,686,701 B1
(45) Date of Patent: Feb. 3, 2004

(54) STRING LIGHT ASSEMBLY WITH A CONTROL PANEL FOR ILLUMINATION OF PARTICULARLY COLORED BULBS UPON A DECORATIVE LIGHT STRING

(76) Inventor: Robin Fullarton, 2956 W. 102nd St., Evergreen Park, IL (US) 60805

( * ) Notice: Subject to any disclaimer, the term of this patent is extended or adjusted under 35 U.S.C. 154(b) by 0 days.

(21) Appl. No.: 10/425,433

(22) Filed: Apr. 29, 2003

(51) Int. Cl.[7] ..... H05B 39/00; F21S 4/00
(52) U.S. Cl. ..... 315/185 S; 362/806
(58) Field of Search ..... 315/185 S; 362/249–252, 362/806

(56) References Cited

U.S. PATENT DOCUMENTS 4,428,988 A * 1/1984 Adinamis ..... 428/8
5,639,157 A * 6/1997 Yeh ..... 362/567
5,749,646 A 5/1998 Brittell ..... 362/231
5,813,751 A 9/1998 Shaffer ..... 362/249
5,828,183 A 10/1998 Wang et al. ..... 315/185.5
6,231,210 B1 * 5/2001 Pendergrass ..... 362/249
6,431,730 B1 * 8/2002 Deutsch et al. ..... 362/252

* cited by examiner

*Primary Examiner*—Don Wong
*Assistant Examiner*—Minh D A
(74) *Attorney, Agent, or Firm*—Goldstein Law Offices, P.C.

(57) ABSTRACT

A string light assembly having a control panel and at least one decorative light string. The control panel has a plurality of color enabling switches for selectively illuminating only light bulbs of a particular color located upon the decorative light strings. In use, a user strings the decorative light strings with a plurality of light bulbs having an assortment of colors. The user chooses which of those colors will be illuminated on a particular occasion by activating only those switches which correspond to the desired colors. The control panel has a timer for automatically turning on and turning off the light bulbs on the decorative light strings at times which are predetermined by the user. The control panel may be powered by standard alternating current or by solar power.

6 Claims, 3 Drawing Sheets

STRING LIGHT ASSEMBLY WITH A CONTROL PANEL FOR ILLUMINATION OF PARTICULARLY COLORED BULBS UPON A DECORATIVE LIGHT STRING

BACKGROUND OF THE INVENTION

1. Field of the Invention

The invention generally relates to a string light assembly, and in particular relates to a string light assembly with a control panel having color enabling switches for illumination of particularly colored bulbs upon a decorative light string.

2. Description of the Related Art

A variety of string light assemblies and special effect light assemblies are available. For example, U.S. Pat. No. 5,749,646 to Britell appears to show a special effect light assembly capable of emitting different colors of light at different times according to which colored lights are illuminated. However, Britell fails to provide a light assembly which allows a user to choose which particular colored lights will be illuminated.

Additionally, U.S. Pat. No. 5,828,183 to Wang appears to show a flashing control circuit for controlling the sequence of flashing lights on a decorative light string at suitable intervals. However, Wang does not provide a light assembly which allows a choice of which particular colored lights will be illuminated.

U.S. Pat. No. 5,813,751 to Shafer appears to show a device for permanent installation of decorative light strings. Accordingly, Shafer does not provide a string light assembly with a particular special lighting effect.

Similarly, U.S. Pat. No. 6,231,210 to Pendergrass appears to show a string light assembly having markings for identifying installation locations on an associated frame. Accordingly, Pendergrass also fails to provide a string light assembly with a particular special lighting effect.

While these devices may be suitable for the particular purpose employed, or for general use, they would not be as suitable for the purposes of the present invention as disclosed hereafter.

SUMMARY OF THE INVENTION

It is an object of the invention to provide a string light assembly which allows a user to choose the particular colored bulbs that he/she wants to illuminate upon a decorative light string. Accordingly, the string light assembly has a control panel having a plurality of switches wherein each switch is used for illuminating only bulbs of a particular color upon the decorative light string.

It is another object of the invention to provide a string light assembly which saves the user the time needed for stringing different colored bulbs on the decorative light strings on various holiday seasons. Accordingly, once the decorative light string has been strung with a plurality of variously colored light bulbs, the user activates only the color enabling switches corresponding to the colors that are desired by the user, thereby saving the user the time needed for stringing different colored bulbs on the decorative light strings on various holiday seasons.

It is yet another object of the invention to provide a string light assembly which illuminates and shuts off the associated decorative light bulbs at a predetermined time of the day which is chosen by the user. Accordingly, the control panel has a timer for setting the time at which the light bulbs will be illuminated, and also the time at which the bulbs cease to be illuminated.

It is an additional object of the invention to provide a string light assembly which saves the user the expense of having to buy different decorative light strings for different occasions. Accordingly, the user may illuminate only those colored light bulbs on the decorative light string which are appropriate for a particular occasion, thereby saving the user the expense of having to buy different decorative light strings for different occasions.

It is a further object of the invention to provide a string light assembly which does not take up a great deal of storage space. Accordingly, the decorative light strings may be left in place on a surface of the home throughout the year, and therefore does not take up a great deal of storage space.

The invention is a string light assembly having a control panel and at least one decorative light string. The control panel has a plurality of color enabling switches for selectively illuminating only light bulbs of a particular color located upon the decorative light strings. In use, a user strings the decorative light strings with a plurality of light bulbs having an assortment of colors. The user chooses which of those colors will be illuminated on a particular-occasion by activating only those switches which correspond to the desired colors. The control panel has a timer for automatically turning on and turning off the light bulbs on the decorative light strings at times which are predetermined by the user. The control panel may be powered by standard alternating current or by solar power.

To the accomplishment of the above and related objects the invention may be embodied in the form illustrated in the accompanying drawings. Attention is called to the fact, however, that the drawings are illustrative only. Variations are contemplated as being part of the invention, limited only-by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 2:
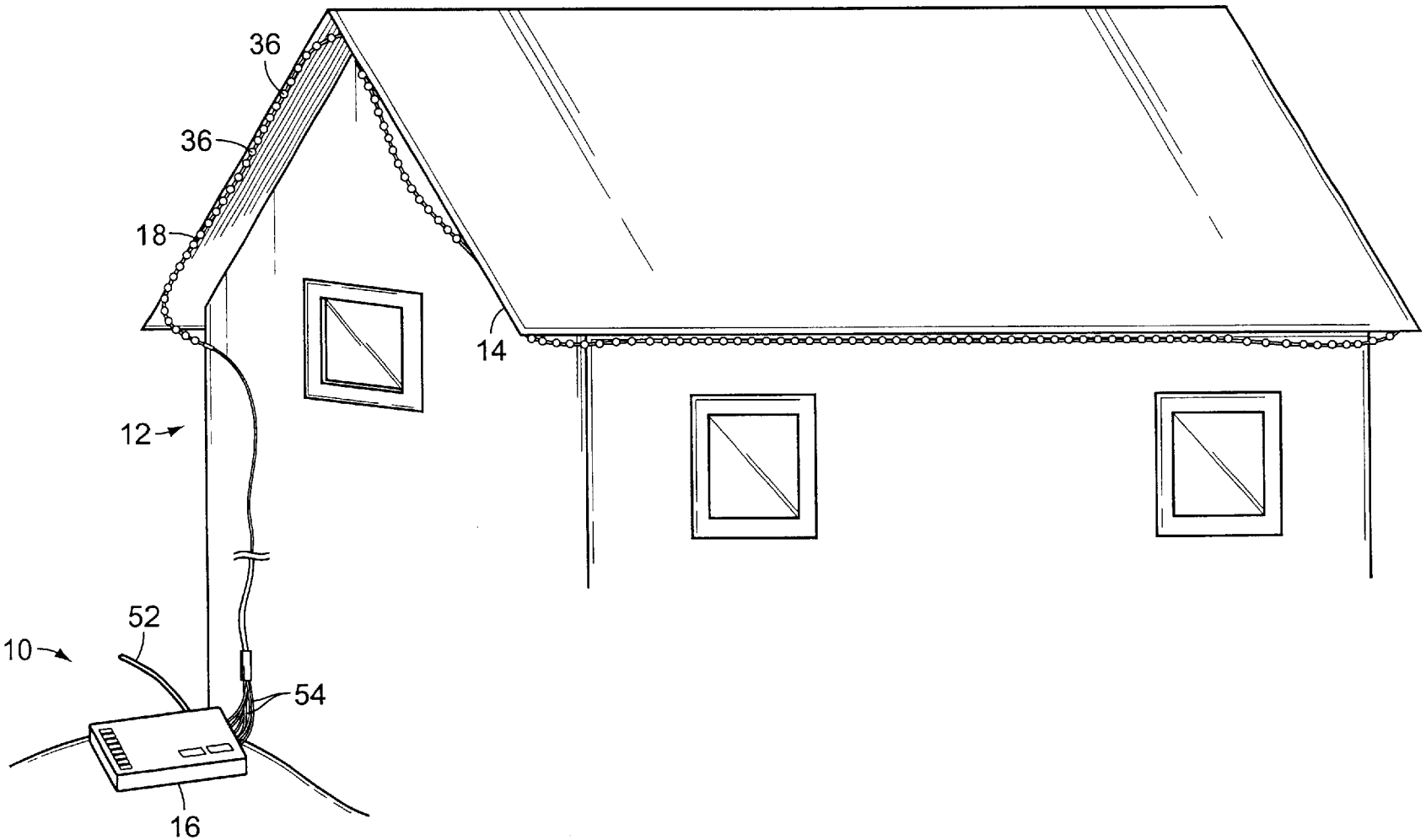
FIG. 2 is a perspective view of the string light assembly after installation of the decorative light string upon a roof a home.

FIG. 2 illustrates the string light assembly 10 after installation on a home 12 having a roof 14. The string light assembly 10 comprises a control panel 16 and at least one decorative light string 18 in electrical communication with the control panel 16. The decorative light string 18 has a plurality of light bulbs 36, each having a color. The decorative light string 18 has a plurality of pre-selected particular colors. In particular, the pre-selected particular colors may include: red, green, orange, white, yellow, and more. The colors of each of the light bulbs which make up the decorative light string 18 being of one of these pre-selected particular colors. Such light bulbs 36 may be grouped together with other light bulbs 36 having that same wire, and are in fact wired together so -that the light bulbs of each pre-selected color can be distinctively illuminated together. Generally, numerous light bulbs on the string are colored in each of the pre-selected particular colors.

Figure 1:
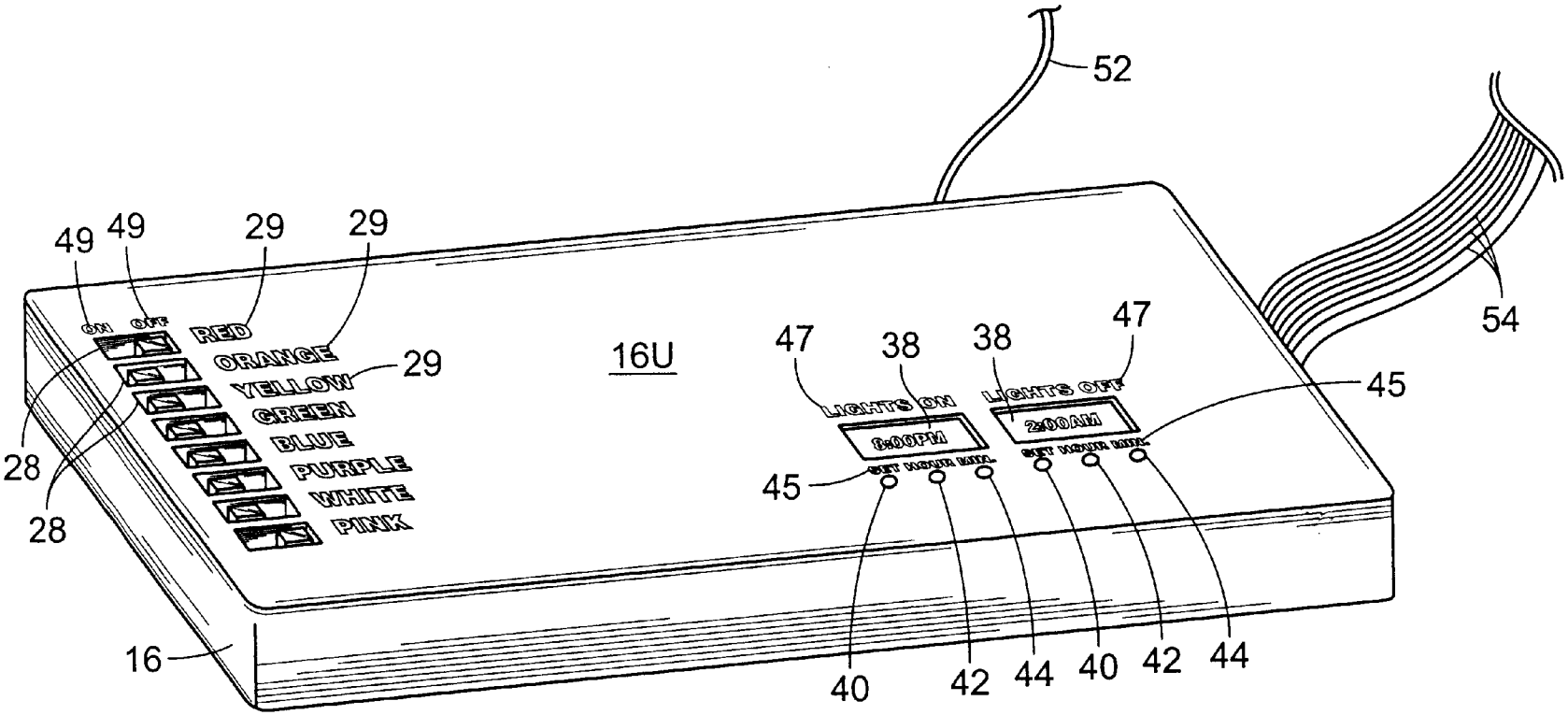
FIG. 1 is a perspective view of the control panel which determines the illumination of a decorative light string.

FIG. 1 illustrates a perspective view of the substantially rectangular control panel 16 which controls the illumination of the decorative light string 18. The control panel 16 is selectively connected to a standard alternating power source by a power cord 52. The control panel 16 is alternately powered by a solar panel when ambient lighting conditions so permit, which charges an internal battery, for subsequent illumination of the decorative light string 18.

The control panel 16 has a plurality of wires 54 for separately supplying an electric current to groups of light bulbs 36 of each particular color located upon the decorative light string 18. The control panel 16 has an upper surface 16U having a plurality of color enabling switches 28. Each color enabling switch 28 is an on/off switch which selectively illuminates all light bulbs 36 of a particular color located upon the decorative light strings 18. The "on" and the "off" positions are labeled with indicia 49. Each color enabling switch 28 is labeled with indicia 29 indicating the particular color of the light bulbs which are illuminated by that particular switch 28. The control panel 16 contains a timer for illuminating the decorative light strings 18 at predetermined times of the day as selected by the user. The timer has two time displays 38 located on the upper surface 16U of the control panel 16. One time display 38, labeled by indicia 47 with the words "LIGHTS ON", indicates the time at which the light bulbs 36 will be turned on. The other display 38, labeled by indicia 47 with the words "LIGHTS OFF", indicates the time at which the light bulbs 36 will be turned off. Each display 38 has an associated "set" button 40, an "hour" button 42, and a "minute" button 44, each labeled by indicia 45. The user sets the time at which the light bulbs 36 will be illuminated by use of the buttons 40, 42, 44. In particular, to set the time at which the light bulbs are illuminated, the user first presses the "set" button 40. The user then sets the hour at which the light bulbs will be illuminated by repeatedly pressing down upon the "hour" button 42 until the desired hour is viewable upon the display 38. The user then proceeds to set the minute past the hour at which the bulbs will be illuminated by pressing down upon the "minute" button 44 until the correct minute past the hour is viewable upon the display 38. The user analogously sets the "lights off" display 38 with the buttons 40, 42, 44 positioned below that display 38, in order to set the time at which the light bulbs cease to be illuminated.

Figure 3:
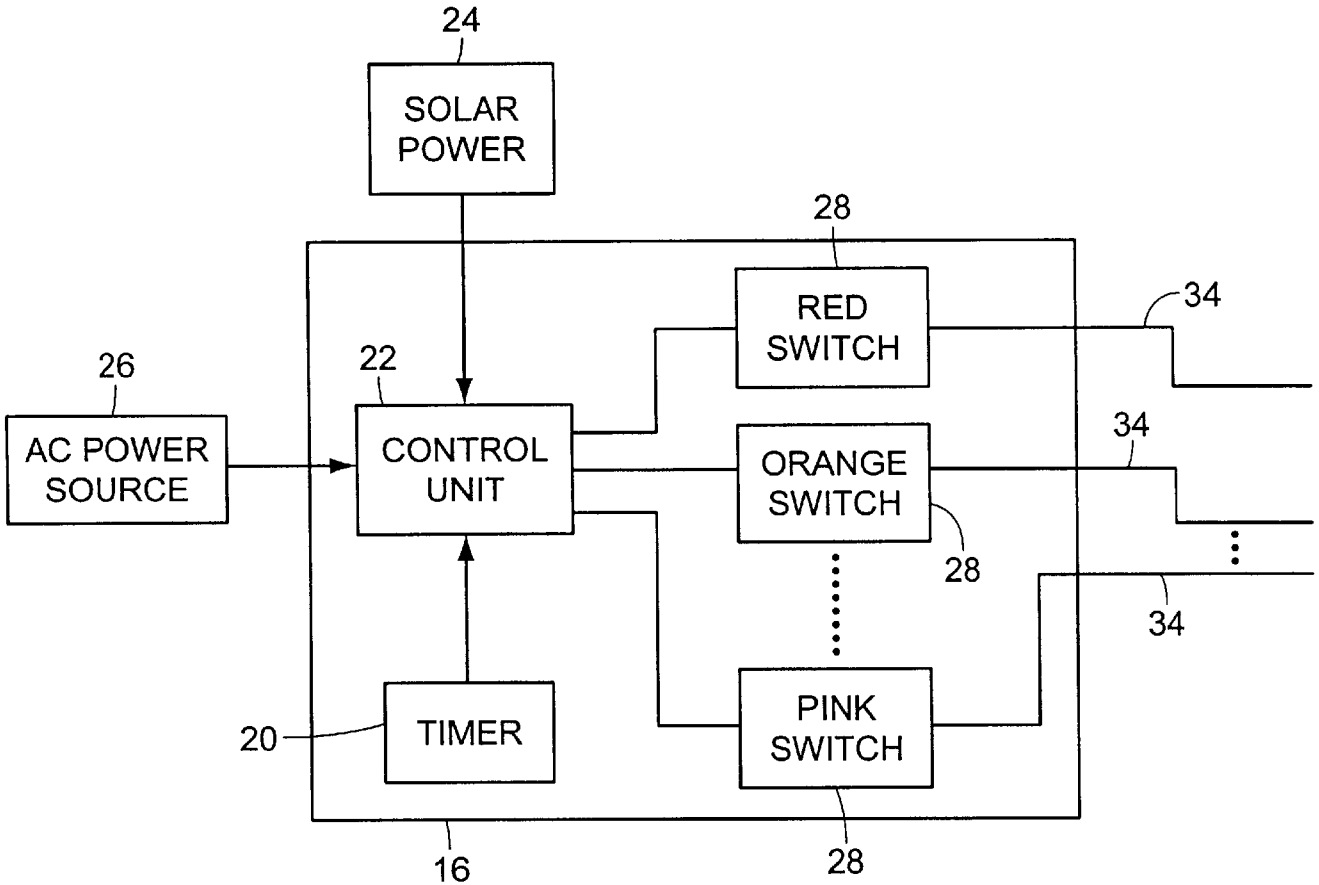
FIG. 3 is a block diagram illustrating interconnection of various electrical components of the invention.

FIG. 3 is a block diagram illustrating interconnection of various electrical components of the invention. The control panel 16 has a control unit 22, a timer 20, and a plurality of color enabling switches 28, each having an "on" and an "off" position. The color enabling switches 28 are each in electrical communication with a wire 34 which supplies current to the group of light bulbs 36 of a particular color, located upon the decorative light string 18. The timer 20 activates and deactivates the control unit 22 to illuminate the light bulbs 36 at certain times of the day as selected by the user. The control panel 16 may be powered by an AC power source 26, or it may be powered by solar power 24 provided by a solar panel located on the control panel 16.

The control unit 22 may generate illumination sequences which can include keeping all bulbs on steady, sequencing between the different colored lights, and flashing some or all of the lights. The color enabling switches 28 determines which colored light bulbs 36 can be illuminated by the control unit 22. Accordingly, regardless of the illumination sequences of the control unit 22, the user has the final say in determining the color scheme of the decorative light string 18 of the string light assembly 10.

In use, the user strings the decorative light strings 18 of the string light assembly 10 with variously colored light bulbs 36. The decorative light strings 18 are positioned upon various surfaces around the home, according to the aesthetic preferences of the user. The user then plugs the string light assembly 10 into a standard electrical outlet which supplies alternating current, or alternately, ensures that the solar panel on the control panel 16 is placed in direct sunlight, for solar powering of the control panel 16. The user then turns on the color enabling switches 28 corresponding to the colored bulbs 36 whose pre-selected particular color is appropriate for the particular occasion at hand. For example, during the Christmas season, the user might choose to illuminate only the green and red light bulbs, by turning on only the color enabling switches which illuminate those particular colored bulbs. Similarly, during the Halloween season, the user might choose to illuminate only the orange bulbs, by turning on only the color enabling switches which illuminate those particular colored bulbs. Further, on Valetine's Day, the user might choose to illuminate only white and Red bulbs, by turning on only the color enabling switches which illuminate those particular colored bulbs. The timer 20 within the control panel 16 illuminates the light bulbs 36 upon the decorative light strings 18 "on" or "off" at particular times of the day or night, according to settings which have been preset by the user, and can only can illuminate those light bulbs which have been enabled using the color enabling switches 28.

In conclusion, herein is presented a string light assembly which has a control panel with color enabling switches for illumination of particularly colored bulbs upon a decorative light string. The invention is illustrated by example in the drawing figures, and throughout the written description. It should be understood that numerous variations are possible, while adhering to the inventive concept. Such variations are contemplated as being a part of the present invention.

What is claimed is:

1. A string light assembly, for decorative use on a variety of occasions, comprising:

at least one decorative light string having a plurality of bulbs, each bulb having a color being one of a plurality of pre-selected particular colors, such that the decorative light string contains groups of bulbs, each group being of a particular color; and a control panel in electrical communication with the at least one decorative light string, said control panel for controlling the illumination of the at least one decorative light string, said control panel having a plurality of color enabling switches, wherein each color enabling switch allows a user to separately enable or disable illumination of each group of particularly colored light bulbs, said control panel having a plurality of wires in communication with the color enabling switches, wherein each wire selectively supplies an electric current to the group of light bulbs of one of the particular colors.

2. The string light assembly as recited in claim 1, wherein the control panel contains a timer for illuminating the light bulbs at predetermined times of the day as selected by a user.

3. The string light assembly as recited in claim 2, wherein the timer has two time displays which are located on the upper surface of the control panel, one time display indicating the time when the light bulbs will be turned on, and the other time display for indicating the time when the light bulbs will be turned off, wherein each display has associated buttons for setting the time at which the light bulbs will be turned on or off.

4. A method of using a string light assembly, said string light assembly having at least one decorative light string having a plurality of differently colored light bulbs arranged in groups of light bulbs having-a particular color, said string light assembly also having a control panel in electrical communication with the at least one decorative light string, said control panel for controlling the illumination of the at least one decorative light string, said control panel having a plurality of color enabling switches, wherein each color enabling switch selectively illuminates light bulbs of one group of bulbs of a particular color, said control panel having a plurality of wires connecting the color enabling switches with light bulbs of a particular color, said method comprising the steps of:

a) stringing the at least one decorative light string with variously colored light bulbs;

b) positioning the decorative light strings upon a surface to be decorated;

c) enabling a desired color scheme for the string light assembly by turning on the color enabling switches by the user which correspond to particularly colored light bulbs suitable for a particular occasion;

d) powering the string light assembly by a power source chosen from the group consisting of an alternating current power source and a solar power source; and e) illuminating only those light bulbs which are among the particularly colored light bulbs enabled by the color enabling switches.

5. The method of using a string light assembly as recited in claim 4, wherein said control panel further has a timer for illuminating the light bulbs only at predetermined times of the day as selected by the user, wherein the step of powering the string light assembly is followed by the step of setting the timer to automatically turn on and off the light bulbs at a particular time of the day, and the step of illuminating the light bulbs occurs at the time of day set by the user.

6. The method of using a string light assembly as recited in claim 5, wherein the step of illuminating occurs after the turn on time of day has been reached and is discontinued when the turn off time of day has been reached.

* * * * *